US005507579A

United States Patent [19]

Sorenson

[11] Patent Number: 5,507,579

[45] Date of Patent: Apr. 16, 1996

[54] SANDWICH BAG

[75] Inventor: John F. Sorenson, Naperville, Ill.

[73] Assignee: Perseco Division of The HAVI Group LP, Oak Brook, Ill.

[21] Appl. No.: 166,988

[22] Filed: Dec. 13, 1993

[51] Int. Cl.[6] ..... B65D 30/20

[52] U.S. Cl. ..... 383/207; 229/938; 383/66; 383/120

[58] Field of Search ..... 229/938, 103, 229/122, 117.01, 243; 383/120, 98, 99, 207, 208, 66

[56] References Cited

U.S. PATENT DOCUMENTS

| | | | |
|---|---|---|---|
| 355,010 | 12/1886 | Farnsworth . | |
| 380,263 | 3/1888 | Lorenz . | |
| 380,264 | 3/1888 | Lorenz . | |
| 584,555 | 6/1897 | Lorenz . | |
| 584,556 | 6/1897 | Lorenz . | |
| 1,722,931 | 7/1929 | Maloney | 383/99 |
| 1,881,890 | 10/1932 | Offenbacher . | |
| 1,991,450 | 2/1935 | Doble | 383/104 |
| 2,306,335 | 12/1942 | Feigenbutz . | |
| 2,389,291 | 11/1945 | Bergstein | 229/117.01 |
| 2,594,394 | 4/1952 | Casselman et al. | 229/117.01 |
| 2,701,878 | 2/1955 | Davis | 383/120 |
| 2,774,531 | 12/1956 | Rosenthal . | |
| 2,831,624 | 4/1958 | Lever . | |
| 2,837,267 | 6/1958 | Potdevin et al. | 383/123 |
| 3,035,754 | 5/1962 | Meister . | |
| 3,099,593 | 7/1963 | Syracuse . | |
| 3,227,359 | 1/1966 | Hanlon . | |
| 3,508,701 | 4/1970 | Saito et al. . | |
| 3,594,177 | 7/1971 | McGowan . | |
| 4,292,332 | 9/1981 | McHam . | |
| 4,344,537 | 8/1982 | Austin | 229/243 |
| 4,484,350 | 11/1984 | Gordon . | |
| 4,618,992 | 10/1986 | La Grotteria . | |
| 4,781,297 | 11/1988 | Abrahamsson et al. . | |
| 4,915,235 | 4/1990 | Roosa | 229/243 |
| 5,078,273 | 1/1992 | Kuchenbecker | 229/243 |
| 5,335,996 | 8/1994 | Cortopassi et al. | 383/207 |

FOREIGN PATENT DOCUMENTS

| | | | |
|---|---|---|---|
| 1804423 | 5/1970 | Germany . | |
| 302849 | 12/1928 | United Kingdom | 229/117.01 |
| 317589 | 8/1929 | United Kingdom | 229/117.01 |

*Primary Examiner*—Stephen P. Garbe

*Attorney, Agent, or Firm*—Willian Brinks Hofer Gilson & Lione

[57] ABSTRACT

A bag for enclosing an object having a top face, a bottom face and a side panel. The side panel has a first fold line attached to the top face and a second fold line attached to the bottom face, wherein the side panel has a third fold line defining a first area and a second area and wherein the first area defines a trapezoid. In other embodiments, the first area may be a rectangle, a five sided area defined by a rectangle and either a trapezoid or a rounded gusset area. In addition there is disclosed a bag that is convertible into an eating surface. The convertible bag has a top face and a bottom face with each having a first edge and a second edge. A pair of side panels are attached to the side panels along the first and second edges so that they extend substantially perpendicular with respect to the top and bottom faces. The top face is detachable from the first and second side panels so that an eating surface defined by the bottom surface and the first and second side panels is revealed, wherein the first and second side panels are substantially perpendicular with respect to the bottom face.

64 Claims, 8 Drawing Sheets

FIG. 5
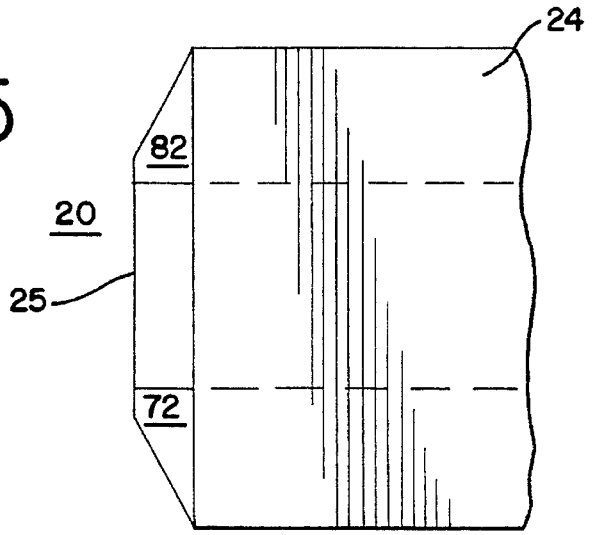
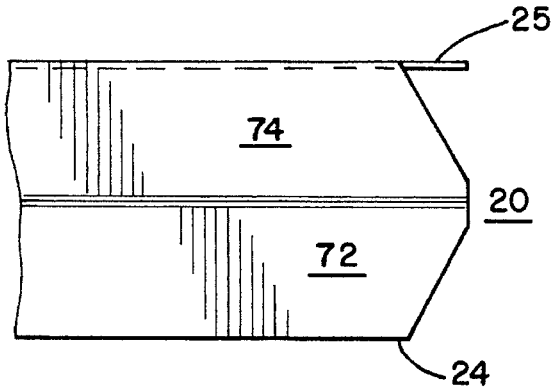
FIG. 6
FIG.7
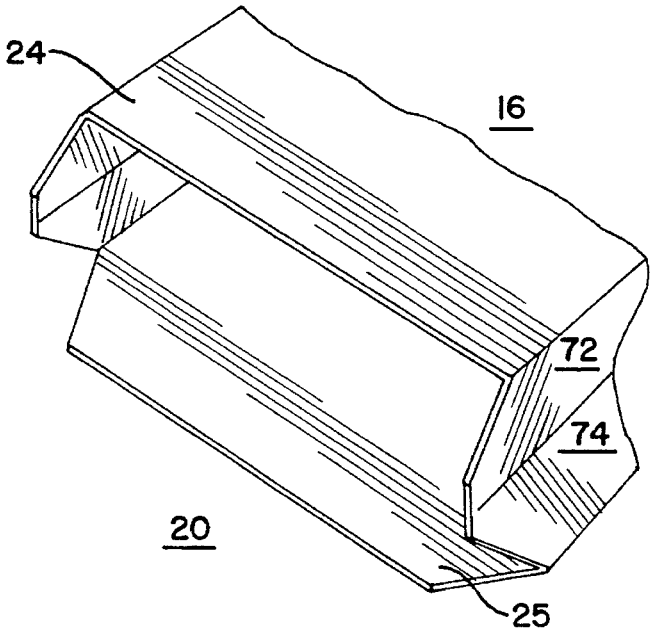

SANDWICH BAG

BACKGROUND OF THE INVENTION

This invention relates to a bag for containing food items, such as sandwiches and hamburgers, that provides improved insertion properties and is capable of being converted to an eating surface.

A common problem with such food bags is that the insertion of the food item into the bag may be cumbersome. Several patents have addressed this problem by modifying the gussets at the open end of the bag. For example, U.S. Pat. No. 355,010 to Farnsworth discloses creases extending from the corners of the open mouth of the bag downwardly toward the central fold of the gusset. Upon opening the bag, the generally triangular regions defined by the creases in the gusseted side panels tend to spring out and enlarge the mouth of the bag and keep the mouth of the bag open.

U.S. Pat. Nos. 584,555 and 584,556, both to Lorenz, disclose the use of folds or creases in the gusset panels extending downwardly from the open mouth of the bag toward the central fold of the gusset. As with the Farnsworth patent, the regions defined by the creases in the gusseted side panels tend to spring out when the bag is opened, enlarge the mouth of the bag and keep the mouth open.

Further disclosures of the use of creases in the gussets near the mouth of the bag to facilitate the filling of a bag are present in U.S. Pat. Nos. 380,263 and 380,264, both to Lorenz.

Despite the modifications disclosed in the past, there is still a need to improve the insertion of food items in bags to avoid costly delays in serving the customer. Accordingly, it is an object of the present invention to provide a bag structure that leads to improved insertion of items into the bag.

Another problem with bags is that they may have a structure that is functionally inadequate to be used as an eating surface. U.S. Pat. No. 4,618,992 to La Grotteria uses perforations in a paper food bag that can be converted into a flat place mat. Conversion is accomplished by tearing the bag along perforations that serve to mark and guide the direction of tearing. A first line of tearing perforations extends circumferentially around the bag near its closed end. A second line of tearing perforations extends from the open end of the bag to the first line of tearing perforations.

The La Grotteria patent has the disadvantage that it is cumbersome to convert to a flat place mat since one is required to perform two separate tearing operations. Accordingly, it is an object of the present invention to provide a bag structure that lends itself to improved conversion to an eating surface.

SUMMARY OF THE INVENTION

One or more of the above-mentioned objects along with other objects are accomplished by a bag for enclosing an object having a top face, a bottom face and a side panel. The side panel has a first fold line attached to the top face and a second fold line attached to the bottom face, wherein the side panel has a third fold line defining a first area and a second area so that the first area comprises a trapezoid.

The above-mentioned bag provides the advantage of improved insertion of items into a bag.

Another aspect of the present invention includes a perforation on a bag so that once it is torn it produces an eating surface that is not completely flat and also provides the advantage of easy conversion of the bag to an eating surface.

The invention is illustrated more or less diagrammatically in the following drawings wherein:

BRIEF DESCRIPTION OF THE DRAWINGS

FIG. 5 shows a top partial view of the first embodiment of the bag of FIG. 4 when folded and in a compressed mode;

FIG. 6 shows a side view of the first embodiment of the bag of FIG. 4 when folded and in an expanded mode;

FIG. 7 shows a perspective and partial view of a front end of the first embodiment of the bag of FIG. 4 when in an expanded mode, according to the present invention;

DESCRIPTION OF THE PREFERRED EMBODIMENTS

Figure 1:
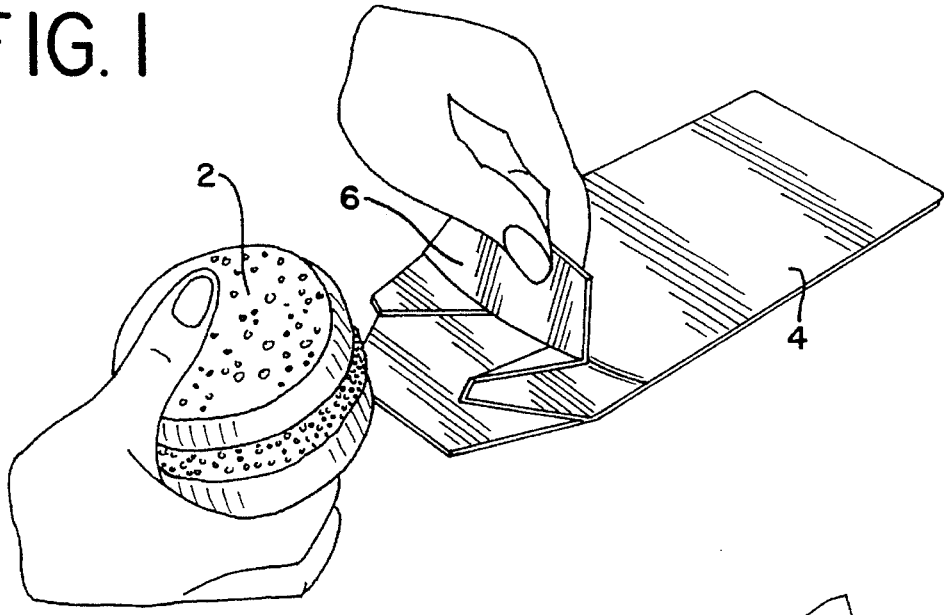
FIG. 1 generally shows a bag according to the present invention, in a compressed mode and being opened to insert an item.
Figure 2:
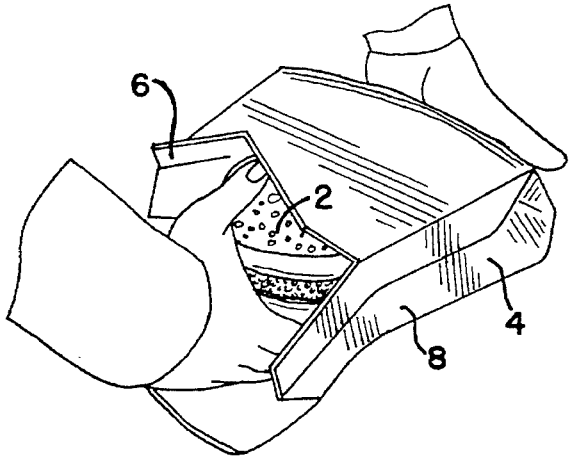
FIG. 2 shows a perspective view of the bag of FIG. 1, in an expanded mode with the item inserted therein, according to the present invention.

FIGS. 1–2 show the general procedure for inserting a food item, such as a sandwich 2, into a bag 4. In FIG. 1, a person picks up sandwich 2 (thumb on top) while lifting the top tab 6 on bag 4 with the free hand. The sandwich 2 is then placed into the bag opening where the bag 4 is pulled over the sandwich 2 while the sandwich 2 is simultaneously slid completely into the bottom of the bag. At this point the bottom of the bag is pushed onto the sandwich with the free hand as shown in FIG. 2. As seen in FIG. 2, insertion of the sandwich 2 into bag 4 is made easier because opening the bag 4 causes the side panels 8 to flare laterally away from the interior of the bag 4. In other words, a portion of a side panel 8 nearest the opening is deflected or bent away from the interior of the bag 4 relative to the remaining portion of the side panel 8. Not wishing to be bound by any theory of operation, it is believed that the flaring of the side panels 8 is caused, at least in part, by the unique shape of the side panels and top and bottom faces near the opening as described in the embodiments of FIGS. 4–17. For example, in FIGS. 4– 9 and 14–17 flaring is aided by having an edge of the top section of the side panel attached to a fold line joining the side panel and top face and angled relative to the same fold line. The amount that the edge is angled ranges from approximately 120° to approximately 150°. In FIGS. 10–13, flaring is accomplished in part by aligning the edge of the side panel with a fold line that attaches the top face and side panel of the bag and using a slit formed along the same fold line. Accordingly, the present invention provides an enlarged opening to insert the sandwich 2. The sandwich 2 is then enclosed in the bag 4 by tucking in the side panels 8 and folding the entire top tab 6 underneath the bag 4 so that the weight of the sandwich 2 holds the bag 4 closed.

Figure 3:
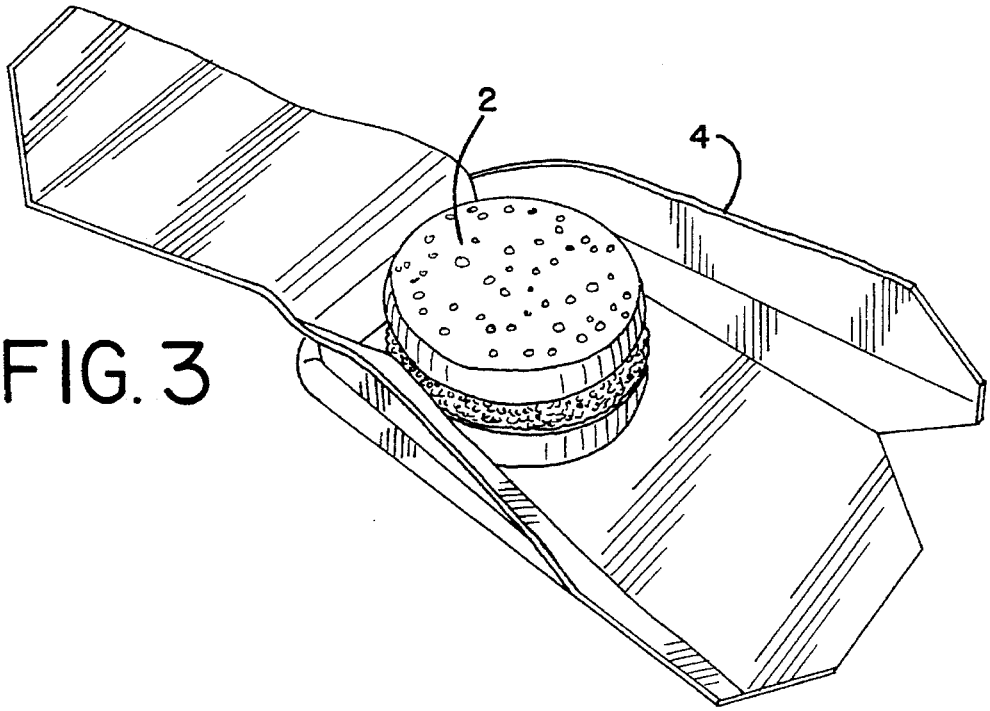
FIG. 3 shows a perspective view of the bag of FIG. 1 when converted to an eating surface, according to the present invention.

The enclosed sandwich 2 is then ready to be served to a person. The person removes the sandwich 2 by unfolding the top tab 6 from underneath the sandwich 2. The person then reaches inside the opening of the bag 4 and pulls out the sandwich 2. In another aspect of the invention, the bag 2 has perforations along the edges of the top surface that allow one to tear the top surface away to form an eating surface as shown in FIG. 3.

The above-described bag 2 has several embodiments as shown in FIGS. 4–17, wherein like elements are represented by like numerals. In the embodiment of the bag of FIGS. 4–9, the bag 4 is made from a single area 10 cut in the shape substantially shown in FIG. 4. The area 10 is made of a single piece of material which is nonporous and has a strength sufficient to support an object to be contained within the bag 4. Examples of such a material are paper, cardboard or plastic.

Figure 8:
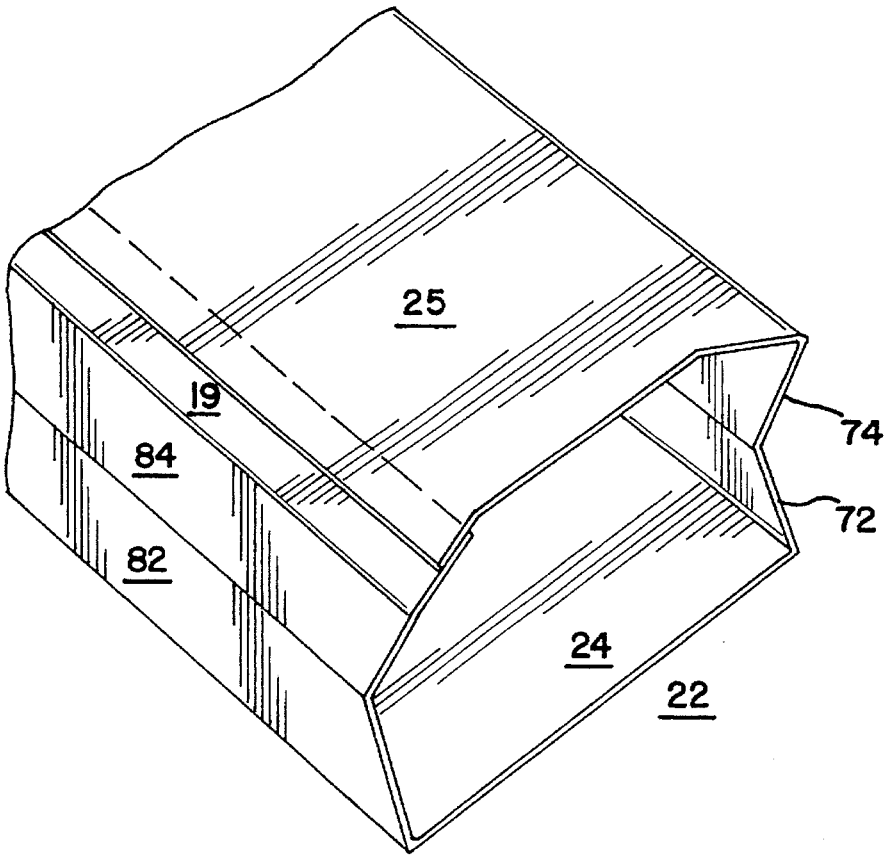
FIG. 8 shows a perspective and partial view of an unfolded rear end of the embodiment of the bags of FIGS. 4–7 and 10–17 when in an expanded mode, according to the present invention.

The area 10 comprises two longitudinal exterior edges 12 and 14 that are used to form the bag 4. As seen in FIGS. 7 and 8, the area 10 is formed in the shape of a rectangular tube 16 by having longitudinal edge 12 overlap longitudinal edge 14 so as to lie parallel to perforated fold line 18, shown by dashed lines. Fold line 18 is spaced approximately 1¼" from longitudinal edge 14 to define an area 19 where the two edges 12, 14 are permanently attached to each other by adhesive 21, such as glue, adhesive tape or a heat seal. The longitudinal edge 12 overlaps edge 14 by approximately ¾", but it is understood that the amount of overlap can vary a great deal depending on the intended purpose of the bag. Thus, the amount of overlap can vary from approximately ⅜" to 3" or more.

As seen in FIGS. 7 and 8, the tube 16 has a front end 20, a rear end 22, a bottom face 24 and a top face 25 which extends beyond the bottom face 24. The bottom face 24 comprises an opening section 26, a middle rectangular section 28 and a fold section 30. Fold section 30 preferably is rectangular in shape having a length of approximately 4.75" and a width of approximately 1.0". Fold section 30 is contained between the area bounded by bottom edge 32, longitudinal fold lines 34, 36 and lateral fold line 38. Longitudinal fold lines 34, 36 are preferably parallel to one another. The bottom edge 32 of fold section 30 may be serrated corresponding to the type of cutting tool employed. It is understood that other shapes for the fold section 30 are possible without departing from the spirit of the invention.

Middle section 28 is adjacent to fold section 30 and preferably is rectangular in shape having a length of approximately 8.25" and a width of approximately 4.75". Middle section 28 preferably is contained between the area bounded by longitudinal fold lines 34, 36, lateral fold line 38 and a hypothetical lateral boundary (dot/dashed lines) 40 that laterally extends between fold lines 34, 36 from the point 42 where either fold line 34, 36 first ends.

Opening section 26 may have several shapes. In one embodiment, shown in FIG. 4, a corner at point 42 is cut off giving section 26 the shape of a right-angled trapezoid. The right-angled trapezoid has a base that coincides with lateral boundary 40 and has a length of approximately 4.75". Section 26 further has a top edge 44 that is substantially parallel to boundary 40, has a length of approximately 4.5" and is spaced approximately ⅛" from boundary 40. Top edge 44 is connected to point 42 by a leg 45 having a length of approximately ¼". Furthermore, the right-angled trapezoid has a second leg 47 that preferably lies along fold line 36, is perpendicular to both boundary 40 and edge 44 and has a length of approximately ⅛".

The shape of section 26 results in the bottom face 24 having a shape that is asymmetric with respect to a plane that bisects fold line 38 and boundary 40. In other embodiments of the invention the shape of the bottom face 24 may be symmetric with respect to such a bisecting plane.

Figure 4:
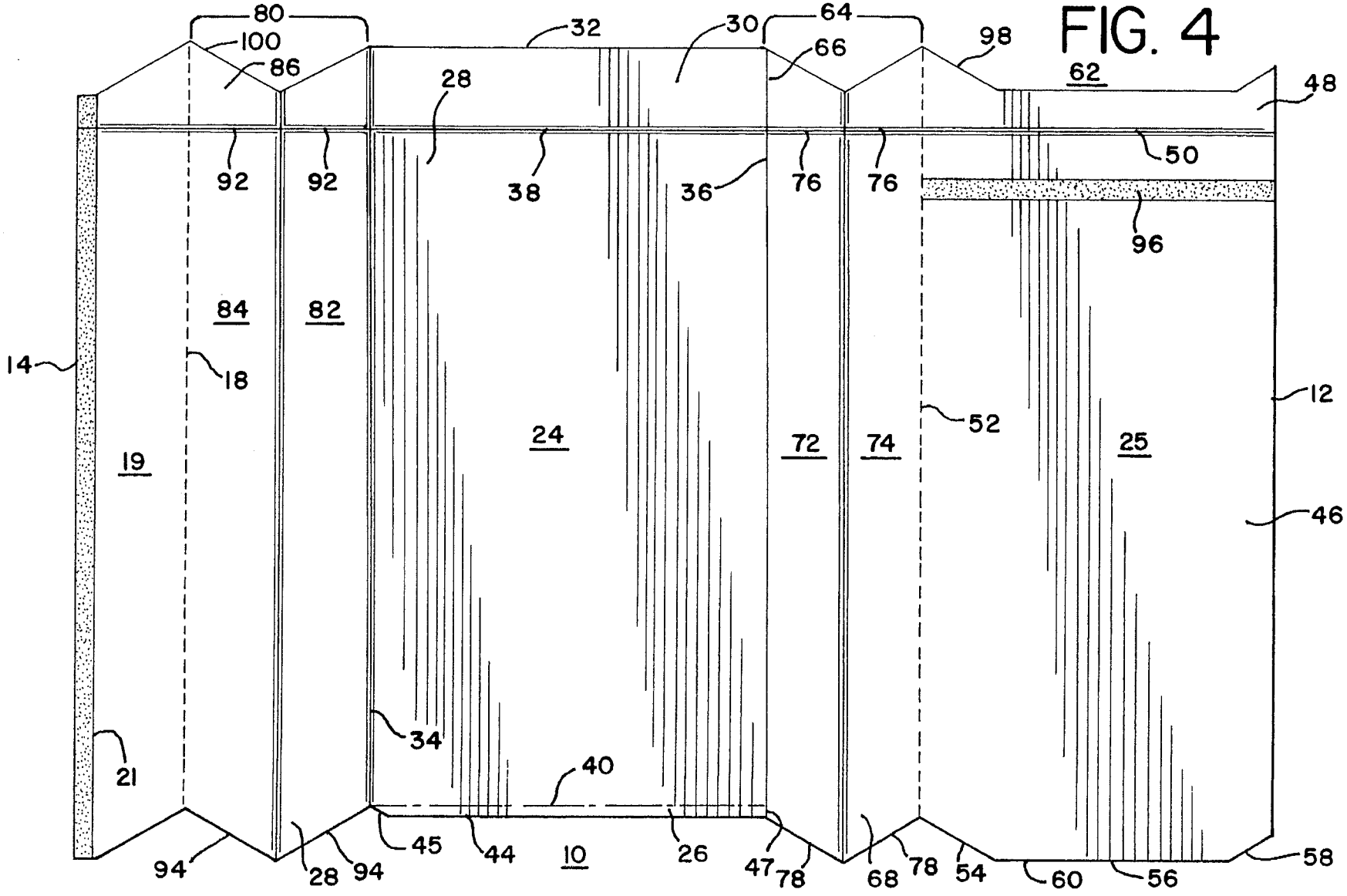
FIG. 4 shows an unfolded view of a first embodiment of a bag, according to the present invention.

Positioned opposite bottom face 24 in the constructed bag 4 is top face 25 having an opening area 46 and a fold area 48. In the embodiment of FIG. 4, opening area 46 has a hexagonal shape bounded by lateral fold line 50, perforated longitudinal fold line 52 (dashed lines), longitudinal edge 12 and three edges 54, 56, 58 defining an opening edge 60. Fold line 50 has a length of approximately 4.75" and preferably is aligned with fold line 38. Fold line 52 and longitudinal edge 12 are preferably parallel with respect to each other having lengths of approximately 8.25" and 8.5", respectively, as measured from fold line 50 to edge 60. Middle edge 56 is preferably positioned 9" from lateral fold line 50 and has a length of approximately 2.5". Middle edge 56 is connected to fold line 52 and edge 12 via edges 54 and 58, respectively. The above-described shape of the top opening section results in an asymmetric shape with respect to a plane that bisects fold line 50. Top face 25 may have a symmetrical shape as well by having the lengths of both fold line 52 and edge 12 being approximately 8.25" or 8.5". Furthermore, middle edge 44 may be positioned 9" from fold line 50 and symmetric with respect to the plane that bisects line 50. With the above-description in mind, top face 25 has a length, as measured from fold line 50, that is greater than the length of bottom face 24, as measured from fold line 38, that provides for improved insertion of a food item within the bag.

Fold section 48 preferably has a length of approximately 4.75" and a width of approximately 1.0". Section 48 may have many shapes such as rectangular. As seen in FIG. 4, section 34 may also be cut so that a recess 62 is formed substantially in the same shape as the top edge 60.

As seen in FIG. 4, fold lines 36 and 52 are attached to each other by a gusseted side panel 64. Side panel 64 has a fold section 66 and a top section 68. The side panel 64 is gusseted by having a fold line 70 defining first area 72 and a second area 74. The first and second areas 72, 74 preferably have the same shape, such as a right-angled trapezoid. First area 72 is defined by the area bounded by fold lines 36, 70, 76 and edge 78. As measured from fold line 76, fold lines 36 and 70 have lengths of approximately 8.5" and 9". Edge 78 has a length of approximately 1.25". Furthermore, fold lines 36 and 70 are preferably parallel to each other and separated from each other by approximately 1". Thus, the angle defined by fold line 52 and edge 78 is approximately 127°. In other embodiments, the angle can range from approximately 120° to approximately 150°.

A second gusseted side panel 80 is attached to fold line 34 of bottom face 24 as seen in FIG. 4. Side panel 80 preferably has the same shape as side panel 64 with first and second identical areas 82 and 84, respectively, having shapes identical as that of areas 72, 74. Consequently, side panel 80 has a fold section 86 and a top section 88. The side panel 80 is gusseted by having a fold line 90 defining first area 72 and a second area 74. The first and second areas 82, 84 preferably have the same shape, such as a right-angled trapezoid. First area 82 is defined by the area bounded by fold lines 34, 90, 92 and edge 94. As measured from fold line 92, fold lines 34 and 90 have lengths of approximately 8.5" and 9". Edge 94 has a length of approximately 1.25". Furthermore, fold lines 34 and 90 are preferably parallel to each other and separated from each other by approximately 1". Thus, the angle defined by fold line 34 and edge 94 is approximately 127°. In other embodiments, the angle can range from approximately 120° to approximately 150°.

Figure 9:
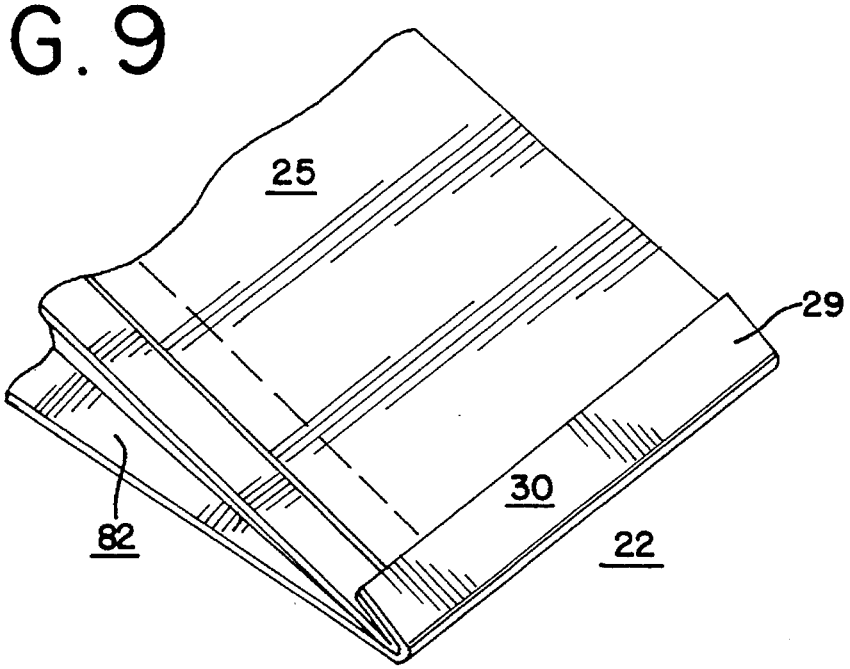
FIG. 9 shows a perspective and partial view of a rear end of the embodiment of the bags of FIGS. 4–7 and 10–17 when sealed to a closed position, according to the present invention.

With the above-described area 10 in mind, the bag 4 can be constructed. Edge 12 is moved so that it overlaps edge 14 by approximately ¾" as shown in FIG. 8 and forms a flattened tube 16, substantially as shown in FIGS. 1 and 5. An adhesive 21 is applied to the area of overlap of edges 12 and 14. Next the bottom portions 30, 48, 66 and 86 of the bag 4 are folded along bottom fold lines 38, 50, 76 and 92 so as to overlap top section 25 as shown in FIG. 9. The bottom portions are then folded onto and attached to the top section 25 by applying an adhesive 96 on top face 25 and located approximately ¾" from fold line 50. With this step a bottom end 29 is formed and the bag is completed. The bag can then be opened as shown in FIGS. 6 and 7 so that a food item can be inserted therein. As described previously, the unique shape of the side panels 64 and 80 and the top and bottom faces cause the same side panels to laterally flare outward upon opening the bag 4. Thus, it is easy to insert a sandwich 2, for example.

Once a food item is inserted in the bag 4, a customer can convert the bag 4 into an eating surface by tearing the top surface 25 along perforations that preferably lie along fold lines 18 and 52 and have a length of approximately 9⅜" extending from the edges 60, 94, respectively, to bottom edges 98, 100, respectively. In another embodiment, lateral perforations may be employed along fold lines 50 and 92 so that the top surface 25 can be completely severed from the bag 4.

Another embodiment of the present invention is shown in FIGS. 10–13. Bag 4 is made from a single area 10 cut in the shape substantially shown in FIG. 10 and is made of the same material described for the embodiment of FIGS. 1–9.

Figure 10:
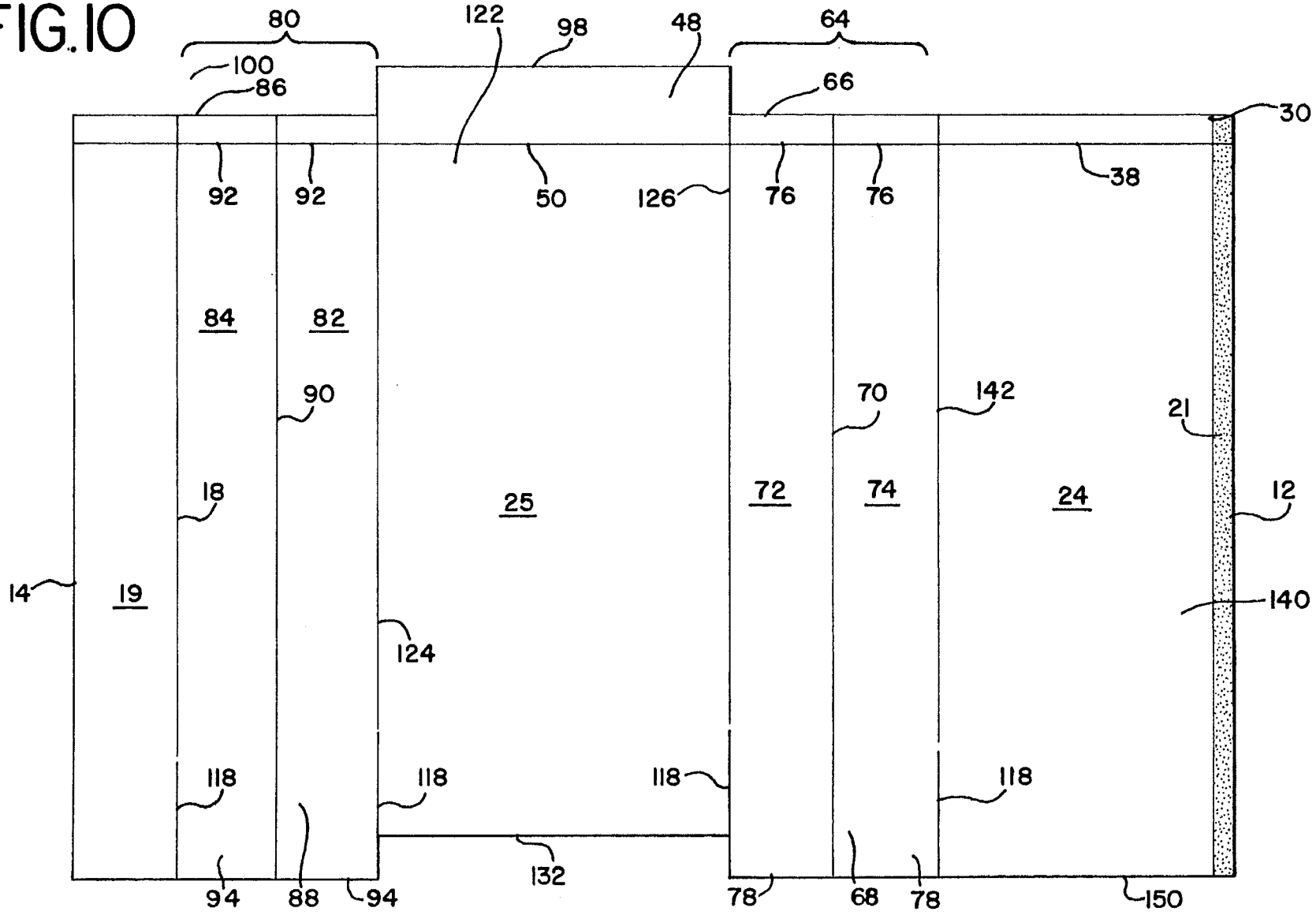
FIG. 10 shows an unfolded view of a second embodiment of a bag, according to the present invention.
Figure 11:
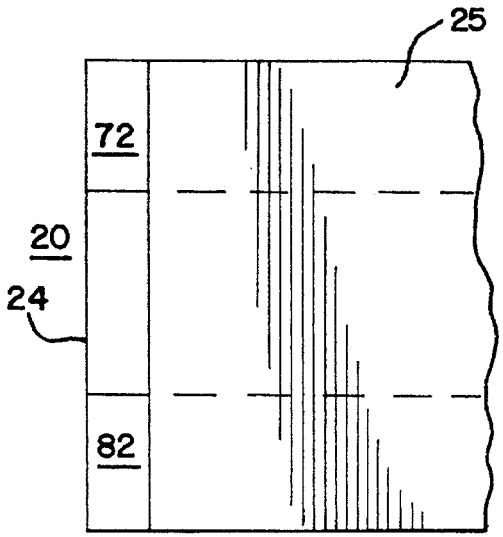
FIG. 11 shows a top partial view of the second embodiment of the bag of FIG. 10 when folded and in a compressed mode.
Figure 14:
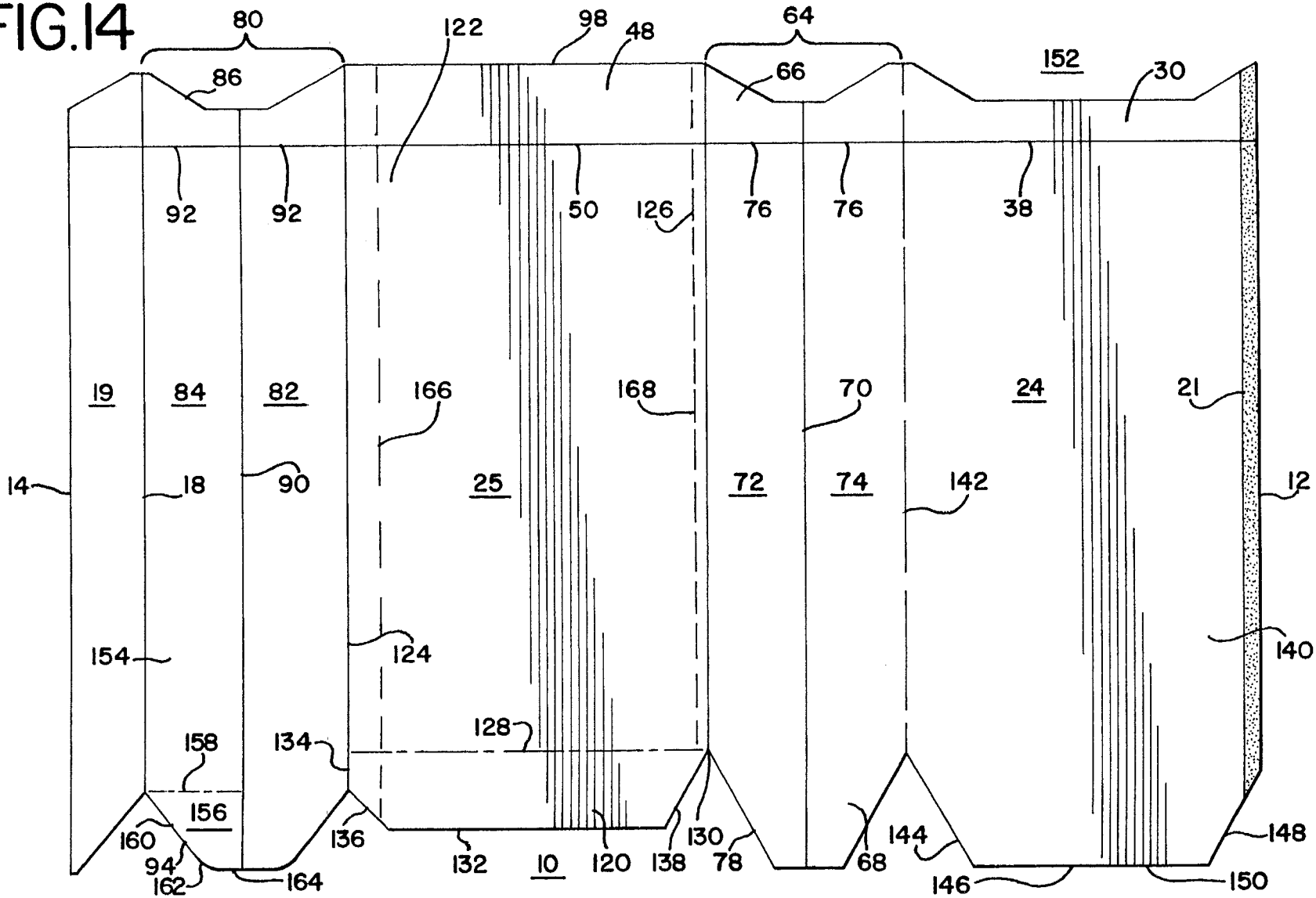
FIG. 14 shows an unfolded view of a third embodiment of a bag, according to the present invention.
Figure 15:
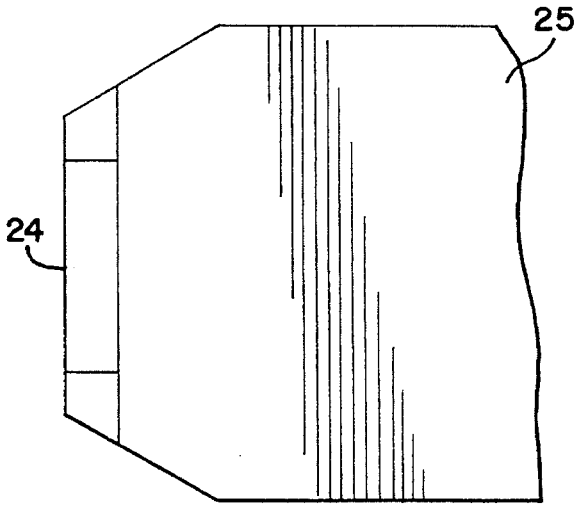
FIG. 15 shows a top partial view of the third embodiment of the bag of FIG. 14 when folded and in a compressed mode.

The area 10 comprises two longitudinal edges 12 and 14 that are used to form the bag 4. As seen in FIG. 14, the area 10 is formed in the shape of a rectangular tube 16 by having longitudinal edge 12 overlap the other side of area 19. The longitudinal edge 12 preferably lies parallel with respect to fold line 18. Fold line 18 is spaced approximately 2⅜" (not to scale) from longitudinal edge 14 to define area 19 where the two edges 12, 14 are permanently attached to each other by adhesive 21 located near edge 12. Adhesive 21 may comprise glue or adhesive tape. The longitudinal edge 12 overlaps the underside of area 19 and edge 14 by approximately ⅝" so that edge 12 is spaced approximately 1¾" from edge 18. Next, the bottom portions 30, 48, 66 and 86 of the bag 4 are folded along bottom fold lines 38, 50, 76 and 92 so as to overlap bottom section 24 in a manner similar to that shown in FIG. 9. The bag is completed by attaching the bottom portions to the bottom section 24 by applying an adhesive. Note that with the sheet of FIG. 4, the exterior side of the bag is shown while the sheet of FIG. 10 shows the interior side of the bag. Consequently, top face 25 and bottom face 24 are switched in position.

Figure 13:
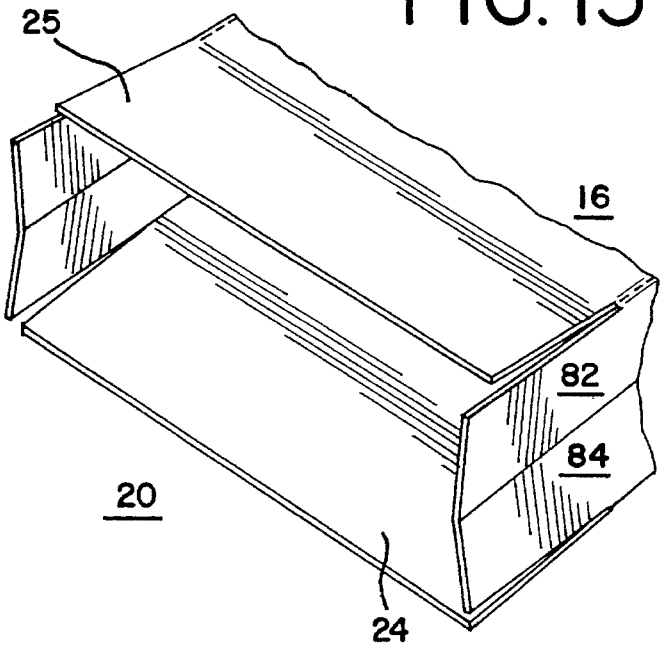
FIG. 13 shows a perspective and partial view of a front end of the second embodiment of the bag of FIG. 10 when in an expanded mode, according to the present invention.

As seen in FIG. 13, the tube 16 has a front end 20, a top face 25 and a bottom face 24 which extends beyond the top face 25. The top face 25 comprises a rectangular section 122 and a fold section 48. Fold section 48 preferably is rectangular in shape having a length of approximately 4⅞" and a width of approximately 1³⁄₁₆". Fold section 48 is contained between the area bounded by bottom edge 98, longitudinal fold lines 124, 126 and lateral fold line 50. Longitudinal fold lines 124,126 are preferably parallel to one another. The bottom edge 98 of fold section 48 may be serrated corresponding to the type of cutting tool employed. It is understood that other shapes for the fold section 48 are possible without departing from the spirit of the invention.

Section 122 is adjacent to fold section 48 and preferably is rectangular in shape having a length of approximately 9¼ and a width of approximately 4⅞". Section 122 preferably is contained between the area bounded by longitudinal fold lines 124, 126, lateral fold line 50 and edge 132.

The shape of section 120 results in the top face 25 having a shape that is symmetric with respect to a plane that bisects fold line 50 and edge 132. In other embodiments of the invention the shape of the top face may be asymmetric with respect to such a bisecting plane.

The bottom face 24 comprises an opening area 140 and a fold area 30. Opening area 140 has a rectangular shape bounded by lateral fold line 38, longitudinal fold line 142, longitudinal edge 12 and opening edge 150. Fold line 38 has a length of approximately 3⅜" and preferably is aligned with fold line 50. Fold line 142 and longitudinal edge 12 are preferably parallel with respect to each other and each having lengths of approximately 10", as measured from fold line 38 to edge 150. The above-described shape of the top opening section results in a symmetric shape with respect to a plane that bisects fold line 38. Bottom face 24 may have a asymmetrical shape as well. Fold section 30 preferably is rectangular in shape having a length of approximately 3³⁄₁₆" and a width of approximately ⁹⁄₁₆".

As seen in FIG. 10, fold lines 126 and 142 are attached to each other by a gusseted side panel 64. Side panel 64 has a fold section 66 and a top section 68. The side panel 64 is gusseted by having a fold line 70 defining first area 72 and a second area 74. The first and second areas 72, 74 preferably have the same shape, such as a rectangle. First area 72 is defined by the area bounded by fold lines 126, 70, 76 and edge 78. As measured from fold line 76, fold lines 126 and 70 each have lengths of approximately 10". Edge 78 has a length of approximately 2¾" as measured from fold line 126 and fold line 142. Fold lines 126 and 70 are preferably parallel to each other and separated from each other by approximately 1⅜".

A second gusseted side panel 80 is attached to fold line 124 of top face 25 as seen in FIG. 14. Side panel 80 may have the same shape as side panel 64 with first and second identical areas 82 and 84 formed from fold line 90 having shapes identical as areas 72, 74. In another embodiment, the areas 82, 84 preferably have the same shape wherein area 84 is defined by the area bounded by fold lines 18, 90, 92 and edge 94. Area 84 preferably is a rectangular area 154 having a length of approximately 10" and a width of approximately 1 5/16".

Figure 12:
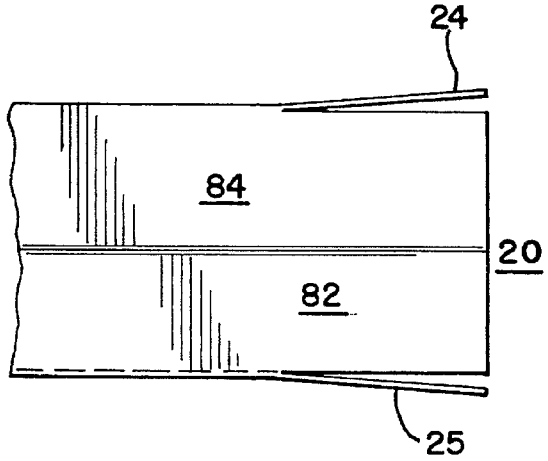
FIG. 12 shows a side view of the second embodiment of the bag of FIG. 10 when folded and in an expanded mode.

The bag can then be opened as shown in FIGS. 12 and 13 so that a food item can be inserted therein. To aid in the insertion of the food item top face 25 is shorter in length than bottom face 24 and slits 118 are cut along one or more of fold lines 18, 124, 126 and 142. The slits 118 for fold lines 18 and 142 having a length of approximately 1 3/8" as measured from edges 94 and 150, respectively. Slits 118 for fold lines 124 and 126 have lengths of approximately 3/4" as measured from edge 132.

Once a food item is inserted in the bag 4, a customer can convert the bag 4 into an eating surface by tearing the top surface 25 along perforations 166 and 168 that preferably lie along fold lines 124 and 126, respectively. In another embodiment, lateral perforations may be employed along fold line 50 so that the top surface 25 can be completely severed from the bag 4.

Another embodiment of the present invention is shown in FIGS. 14–17. Bag 4 is made from a single area 10 cut in the shape substantially shown in FIG. 14 and is made of the same material described for the embodiments of FIGS. 1–13.

In the embodiment of the bag of FIGS. 14–17, the bag 4 is made from a single area 10 cut in the shape substantially shown in FIG. 14. The area 10 is made of a single piece of material which is nonporous and having a strength sufficient to support an object to be contained within the bag 4. Examples of such a material are paper, cardboard or plastic.

Figure 17:
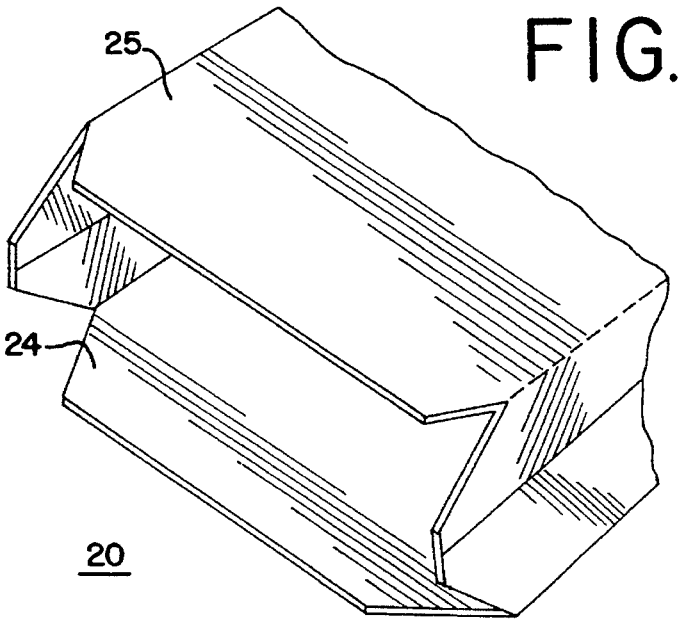
FIG. 17 shows a perspective and partial view of a front end of the third embodiment of the bag of FIG. 14 when in an expanded mode, according to the present invention.

The area 10 comprises two longitudinal edges 12 and 14 that are used to form the bag 4. As seen in FIG. 17, the area 10 is formed in the shape of a rectangular tube 16 by having longitudinal edge 12 overlap the other side of area 19. The longitudinal edge 12 preferably lies parallel with respect to fold line 18. Fold line 18 is spaced approximately 3/4" from longitudinal edge 14 to define area 19 where the two edges 12, 14 are permanently attached to each other by adhesive 21 located near edge 12. Adhesive 21 may comprise glue or adhesive tape. The longitudinal edge 12 overlaps the underside of area 19 and edge 14 by approximately 5/8" so that edge 12 is spaced approximately 1/8" from edge 18. Next, the bottom portions 30, 48, 66 and 86 of the bag 4 are folded along bottom fold lines 38, 50, 76 and 92 so as to overlap bottom section 24 in a manner similar to that shown in FIG. 9. The bag is completed by attaching the bottom portions to the bottom section 24 by applying an adhesive. Note that with the sheets of FIGS. 4 and 10, the exterior side of the bag is shown while the sheet of FIG. 14 shows the interior side of the bag. Consequently, top face 25 and bottom face 24 are switched in position.

As seen in FIG. 17, the tube 16 has a front end 20, a top face 25 and a bottom face 24 which extends beyond the top face 25. The top face 25 comprises an opening section 120, middle rectangular section 122 and a fold section 48. Fold section 48 preferably is rectangular in shape having a length of approximately 5" and a width of approximately 1.0". Fold section 48 is contained between the area bounded by bottom edge 98, longitudinal fold lines 124, 126 and lateral fold line 50. Longitudinal fold lines 124, 126 are preferably parallel to one another. The bottom edge 98 of fold section 48 may be serrated corresponding to the type of cutting tool employed. It is understood that other shapes for the fold section 48 are possible without departing from the spirit of the invention.

Middle section 122 is adjacent to fold section 48 and preferably is rectangular in shape having a length of approximately 8 1/8" and a width of approximately 5". Middle section 122 preferably is contained between the area bounded by longitudinal fold lines 124, 126, lateral fold line 50 and a hypothetical lateral boundary (dot/dashed lines) 128 that laterally extends between fold lines 124, 126 from the point 130 where either fold line first ends.

Opening section 120 may have several shapes. In one embodiment shown in FIG. 14, a corner at point 130 is cut off giving section 120 the shape of a pentagon. The pentagon has a base that coincides with lateral boundary 128 with a length of approximately 5". Section 120 further has a top edge 132 that is substantially parallel to boundary 128, has a length of approximately 3 5/8" and spaced by approximately 1 1/2" from boundary 128. Section 120 further includes an edge 134 lying along fold line 124 and having a length of approximately 5/8". Edge 134 and top edge 132 are connected to each other via edge 136 having a length of approximately 1 1/8". Point 130 and top edge 132 are connected to each other by edge 138 having a length of approximately 1 5/8".

The shape of section 120 results in the top face 25 having a shape that is asymmetric with respect to a plane that bisects fold line 50 and boundary 128. In other embodiments of the invention the shape of the bottom face may be symmetric with respect to such a bisecting plane.

The bottom face 24 comprises an opening area 140 and a fold area 30. In the embodiment of FIG. 14, opening area 140 has a hexagonal shape bounded by lateral fold line 38, longitudinal fold line 142, longitudinal edge 12 and three edges 144, 146, 148 defining an opening edge 150. Fold line 38 has a length of approximately 4 7/8" and preferably is aligned with fold line 50. Fold line 142 and longitudinal edge 12 are preferably parallel with respect to each other having lengths of approximately 8 1/8" and 8.75", respectively, as measured from fold line 38 to edge 150. Middle edge 146 is preferably positioned 10 1/8" from lateral fold line 38 and has a length of approximately 3". Middle edge 146 is connected to fold line 142 and edge 12 via edges 144 and 148, respectively. The above-described shape of the top opening section results in an asymmetric shape with respect to a plane that bisects fold line 38. Bottom face 24 may have a symmetrical shape as well by having the lengths of both fold line 142 and edge 12 being approximately 8 1/8" or 8.75". Furthermore, middle edge 146 may be positioned 10 1/8" from fold line 38 and symmetric with respect to the plane that bisects line 38.

Fold section 30 preferably has a length of approximately 4 7/8" and a width of approximately 1.0". Section 30 may have many shapes such as rectangular. As seen in FIG. 14, section 30 may also be cut so that a recess 152 is formed substantially in the same shape as the top edge 150.

As seen in FIG. 14, fold lines 126 and 142 are attached to each other by a gusseted side panel 64. Side panel 64 has a fold section 66 and a top section 68. The side panel 64 is gusseted by having a fold line 70 defining first area 72 and a second area 74. The first and second areas 72, 74 preferably have the same shape, such as a right-angled trapezoid. First area 72 is defined by the area bounded by fold lines 126, 70, 76 and edge 78. As measured from fold line 76, fold lines 126 and 70 have lengths of approximately 8 1/8" and 10.5". Edge 78 has a length of approximately 2 7/8". In another embodiment shown in FIG. 14, the areas 72 and 74 are truncated 10 1/8" from the fold section 76. Furthermore, fold lines 126 and 70 are preferably parallel to each other and separated from each other by approximately 1". Thus, the angle defined by fold line 126 and edge 78 is approximately 146°. The angle may vary ranging from approximately 120°to approximately 150°.

A second gusseted side panel 80 is attached to fold line 124 of top face 25 as seen in FIG. 14. Side panel 80 may have the same shape as side panel 64 with first and second identical areas 82 and 84 formed from fold line 90 having shapes identical as areas 72, 74. In another embodiment, the areas 82, 84 preferably have the same shape wherein area 84 is defined by the area bounded by fold lines 18, 90, 92 and edge 94. Area 84 is a combination of a rectangular area 154 and a rounded gusset area 156 that are separated from each other by a hypothetical boundary line 158 (dot/dashed lines). As measured from fold line 92, fold lines 18 and 124 each have lengths of approximately 8.5". Fold line 90 has a length of approximately 10" and edge 94 has a linear section 160 having a length of approximately 1⅝" with a curved section 162 extending therefrom to fold line 90. Linear section 160 defines an angle with respect to base 158 ranging from approximately 30° to approximately 60°, preferably approximately 60°. Curved section 162 preferably has a radius of curvature of approximately 1 ⅛" and is truncated such that fold line 90 has a length of approximately 10" as measured from lateral fold line 92. Furthermore, there is a second linear section 164 that has a length of approximately ¼".

Figure 16:
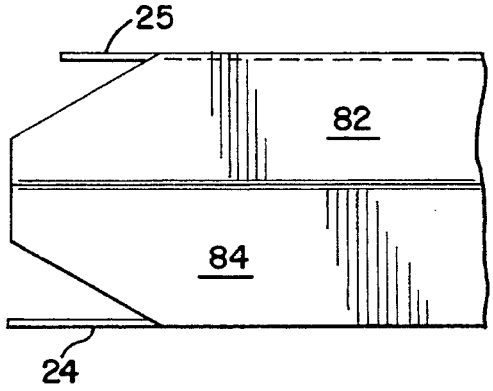
FIG. 16 shows a side view of the third embodiment of the bag of FIG. 14 when folded and in an expanded mode.

The bag can then be opened as shown in FIGS. 16 and 17 so that a food item can be inserted therein. As described previously, the unique shape of the side panels 64 and 80 and top and bottom faces cause the same side panels to laterally flare outward upon opening the bag 4. Thus, it is easy to insert a sandwich 2, for example. As with the embodiments of FIGS. 1–13, insertion is improved by having top face 25 having a shorter length than bottom face 24. Once a food item is inserted in the bag 4, a customer can convert the bag 4 into an eating surface by tearing the top surface 25 along perforations 166 and 168 that lie on surface 25. Perforation 166 preferably lies parallel to fold line 124 and is spaced approximately 3/16" therefrom. Perforation 166 has a length of approximately 10⅛" extending from edge 136 to edge 98. Similarly, perforation 168 preferably lies parallel to fold line 168 and is spaced approximately ⅛" therefrom. Perforation 168 has a length of approximately 9¼" extending from edge 138 to edge 98. In another embodiment, lateral perforations may be employed along fold line 50 so that the top surface 25 can be completely severed from the bag 4.

While the embodiments of the invention disclosed herein are presently considered to be preferred, it is understood that various modifications and improvements can be made without departing from the spirit and scope of the invention. For example, it is understood that the present invention encompasses other shapes and sizes for the bag which depend on the object to be placed therein. The shapes of the side panels may be varied so that a bag contains a side panel from one described embodiment and a side panel from another described embodiment. The perforations described for converting the bag into an eating surface may be used in all of the above-described embodiments and may have any desired pattern to ensure access to the food item. Furthermore, straight edges may be replaced with curved edges that substantially have the same shape as described previously. In addition, it is understood that the side panels and top and bottom surfaces may be used for other types of bags, such as square or rectangular bottom bags. The scope of the invention is indicated in the appended claims and all changes which come within the meaning and range of equivalence of the claims are intended to be embraced therein.

I claim:

1. A bag for enclosing an object, comprising:

a top face having a top edge;

a bottom face;

a first side panel comprising (1) a first fold line attached to said top face and (2) a second fold line attached to said bottom face;

wherein said first side panel comprises a third fold line defining a first area and a second area and wherein said first area comprises five sides and a gusset area having the shape of a first trapezoid;

a second side panel comprising a fourth fold line attached to said top face;

wherein said second side panel comprises a fifth fold line defining a third area and a fourth area and wherein said third area comprises five sides and a gusset area having the shape of a second trapezoid;

said first trapezoid intersecting said first fold line and said top edge at a first point and said second trapezoid intersecting said fourth fold line and said top edge at a second intersection point, wherein said first and second intersection points are offset along a direction parallel to said first fold line.

2. The bag of claim 1, wherein said first area comprises a rectangular area attached to said gusset area.

3. The bag of claim 2, wherein a first base of said trapezoid is attached to a side of said rectangular area.

4. The bag of claim 2, wherein a leg of said trapezoid lies along said third fold line.

5. The bag of claim 2, wherein a side of said rectangular area lies along said third fold line.

6. The bag of claim 4, wherein a side of said rectangular area lies along said third fold line.

7. The bag of claim 4, wherein a second leg and said first base of said trapezoid define an angle ranging from approximately 30° to approximately 60°.

8. The bag of claim 4, wherein a second leg and said first base of said trapezoid define an angle of approximately 31°.

9. The bag of claim 4, wherein a second leg and said first base of said trapezoid define an angle of approximately 56°.

10. The bag of claim 11, wherein said first and fourth fold lines are parallel to each other.

11. The bag of claim 1, wherein the length of said first fold line as measured from said first point is not equal to the length of said fourth fold line as measured from said second point.

12. The bag of claim 1, wherein said first and second trapezoids are not identical in shape.

13. The bag of claim 1, wherein said top face is detachable from said first and second side panels so that an eating surface defined by said bottom surface and said first and second side panels is revealed, wherein said first and second side panels are substantially perpendicular with respect to said bottom face.

14. The bag of claim 13, comprising perforated lines lying along each of said first and fourth folding lines.

15. A bag for enclosing an object, comprising:

a top face having a top edge;

a bottom face;

a first side panel comprising (1) a first fold line attached to said top face and (2) a second fold line attached to said bottom face;

wherein said first side panel comprises a third fold line defining a first area and a second area and wherein said first area comprises five sides and a rounded gusset area;

a second side panel comprising (1) a fourth fold line attached to said top face;

wherein said second side panel comprises a fifth fold line defining a third area and a fourth area and wherein said third area comprises five sides and a gusset area having the shape of a second trapezoid;

said first trapezoid intersecting said first fold line and top edge at a first point and said second trapezoid intersecting said fourth fold line and said top edge at a second intersection point, wherein said first and second intersection points are offset along a direction parallel to said first fold line.

16. The bag of claim 15, wherein said first area comprises a rectangular area attached to said gusset area.

17. The bag of claim 16, wherein a first base of said rounded gusset area is attached to a side of said rectangular area.

18. The bag of claim 16, wherein a side of said rectangular area lies along said third fold line.

19. The bag of claim 16, wherein a leg of said rounded gusset area lies along said third fold line.

20. The bag of claim 19, wherein a side of said rectangular area lies along said third fold line.

21. The bag of claim 19, wherein a second leg and said first base of said rounded gusset area define an angle ranging from approximately 30° to approximately 60°.

22. The bag of claim 15, wherein said first and fourth fold lines are parallel to each other.

23. The bag of claim 15, wherein the length of said first fold line as measured from said first point is not equal to the length of said fourth fold line as measured from said second point.

24. The bag of claim 15, wherein said first and second trapezoids are not identical in shape.

25. The bag of claim 15, wherein said top face is detachable from said first and second side panels so that an eating surface defined by said bottom surface and said first and second side panels is revealed, wherein said first and second side panels are substantially perpendicular with respect to said bottom face.

26. The bag of claim 25, comprising perforated lines lying along each of said first and fourth folding lines.

27. A foldable sheet, comprising:

a first face having a top edge;

a second face;

a first side panel comprising (1) a first fold line attached to said first face and (2) a second fold line attached to said second face;

wherein said first side panel comprises a third fold line defining a first area and a second area and wherein said first area comprises five sides and a gusset area having the shape of a first trapezoid;

a second side panel comprising (1) a fourth fold line attached to said first face;

wherein said second side panel comprises a fifth fold line defining a third area and a fourth area and wherein said third area comprises five sides and a gusset area having the shape of a second trapezoid;

said first trapezoid intersecting said first fold line and said top edge at a first point and said second trapezoid intersecting said fourth fold line and said top edge at a second intersection point, wherein said first and second intersection points are offset along a direction parallel to said first fold line.

28. The foldable sheet of claim 27, wherein said first area comprises a rectangular area attached to said gusset area.

29. The foldable sheet of claim 28, wherein a first base of said trapezoid is attached to a side of said rectangular area.

30. The foldable sheet of claim 28, wherein a leg of said trapezoid lies along said third fold line.

31. The foldable sheet of claim 28, wherein a side of said rectangular area lies along said third fold line.

32. The foldable sheet of claim 30, wherein a second leg and said first base of said trapezoid define an angle ranging from approximately 30° to approximately 60°.

33. The sheet of claim 27, wherein said first and fourth fold lines are parallel to each other.

34. The sheet of claim 27, wherein the length of said first fold line as measured from said first point is not equal to the length of said fourth fold line as measured from said second point.

35. The sheet of claim 27, wherein said first and second trapezoids are not identical in shape.

36. The sheet of claim 27, wherein said top face is detachable from said first and second side panels.

37. The sheet of claim 36, comprising perforated lines lying along each of said first and fourth folding lines.

38. A foldable sheet for enclosing an object, comprising:

a top face having a a bottom face;

a first side panel comprising (1) a first fold line attached to said top face and (2) a second fold line attached to said bottom face;

wherein said first side panel comprises a third fold line defining a first area and a second area and wherein said first area comprises five sides and a rounded gusset area;

a second side panel comprising (1) a fourth fold line attached to said top face;

wherein said second side panel comprises a fifth fold line defining a third area and a fourth area and wherein said third area comprises five sides and a gusset area having the shape of a second trapezoid;

said first trapezoid intersecting said first fold line and said top edge at a first point and said second trapezoid intersecting said fourth fold line and said top edge at a second intersection point, wherein said first and second intersection points are offset along a direction parallel to said first fold line.

39. The foldable sheet of claim 38, wherein said first area comprises a rectangular area attached to said gusset area.

40. The foldable sheet of claim 39, wherein a first base of said rounded gusset area is attached to a side of said rectangular area.

41. The foldable sheet of claim 39, wherein a side of said rectangular area lies along said third fold line.

42. The foldable sheet of claim 39, wherein a leg of said rounded gusset area lies along said third fold line.

43. The foldable sheet of claim 42, wherein a second leg and said first base of said rounded gusset area define an angle ranging from approximately 30° to approximately 60°.

44. The sheet of claim 38, wherein said first and fourth fold lines are parallel to each other.

45. The sheet of claim 38, wherein the length of said first fold line as measured from said first point is not equal to the length of said fourth fold line as measured from said second point.

46. The sheet of claim 38, wherein said first and second trapezoids are not identical in shape.

47. The sheet of claim 38, wherein said top face is detachable from said first and second side panels.

48. The sheet of claim 47, comprising perforated lines lying along each of said first edge and said second edge of said top face.

49. A bag for enclosing an object, comprising:

a top face;

a bottom face;

a first side panel comprising (1) a first fold line attached to said top face and (2) a second fold line attached to said bottom face, said top face, bottom face and first side panel forming an opening to an interior of said bag;

wherein said first side panel comprises a top section extending past said first fold line and having a shape so that said first side panel flares laterally away from the interior of said bag when said bag is opened.

50. The bag of claim 49, wherein said top section has a second edge that is attached to said second fold line and is angled relative to said second fold line.

51. The bag of claim 49, wherein said top section has a first edge that is attached to said first fold line and is angled relative to said first fold line.

52. The bag of claim 51, wherein said top section has a second edge that is attached to said second fold line and is angled relative to said second fold line.

53. The bag of claim 51, comprising a second side panel having (1) a fourth fold line attached to said top face and (2) a fifth fold line attached an area that is overlapped by and attached to said bottom face.

54. The bag of claim 51, comprising perforated lines lying along said first fold line and said fifth fold line to allow said top section to be separated from said bag.

55. The bag of claim 51, wherein said first edge of said top section is angled relative to said first fold line by an amount ranging from approximately 120° to approximately 150°.

56. The bag of claim 55, wherein said first edge of said top section is angled relative to said first fold line by approximately 127°.

57. The bag of claim 55, wherein said first edge of said top section is angled relative to said first fold line by approximately 146°.

58. The bag of claim 51, wherein said top face has a first edge partially forming said opening that is attached to said first fold line and is angled relative to said first fold line.

59. The bag of claim 58, wherein said first edge of said top face and said first edge of said top section intersect at a common point.

60. The bag of claim 49, wherein said top section has a first edge that is attached to said first fold line and is aligned with said first fold line.

61. The bag of claim 60, wherein said top section has a second edge that is attached to said second fold line and is aligned with said second fold line.

62. The bag of claim 60, comprising slits lying along said first and second fold lines.

63. The bag of claim 60, comprising a second side panel having (1) a fourth fold line attached to said top face and (2) a fifth fold line attached an area that overlaps and is attached to said bottom face.

64. The bag of claim 63, comprising perforated lines lying along said first fold line and said fourth fold line to allow said top section to be separated from said bag.

* * * * *

UNITED STATES PATENT AND TRADEMARK OFFICE

CERTIFICATE OF CORRECTION

PATENT NO. : 5,507,579

DATED : April 16, 1996

INVENTOR(S) : John F. Sorenson

It is certified that error appears in the above-indentified patent and that said Letters Patent is hereby corrected as shown below:

In claim 10, line 1, delete "11" and substitute --1--.

In claim 38, line 2, after the second occurrence of "a" insert --top edge;--.

Signed and Sealed this

Twenty-ninth Day of July, 1997

Bruce Lehman

*Attest:*

BRUCE LEHMAN

*Attesting Officer*

*Commissioner of Patents and Trademarks*